United States Patent [19]

Sullivan

[11] Patent Number: 5,046,196

[45] Date of Patent: Sep. 10, 1991

[54] SANITIZATION AND ADAPTATION OF HEADGEAR

[76] Inventor: William W. Sullivan, 17 Old Oak Ave., Westminster, Mass. 01473

[21] Appl. No.: 495,146

[22] Filed: Mar. 19, 1990

[51] Int. Cl.[5] ..... A42C 5/00

[52] U.S. Cl. ..... 2/181.4; 2/181; 2/183; 2/418; 2/DIG. 11

[58] Field of Search ..... 2/181, 181.2, 181.4, 2/182.4, DIG. 11, 183, 197, 417, 418, 420

[56] References Cited

U.S. PATENT DOCUMENTS

| | | | |
|---|---|---|---|
| 1,351,893 | 9/1920 | Curtis | 2/183 |
| 3,309,713 | 3/1967 | Kaufman | 2/183 |
| 3,787,894 | 1/1974 | Goodman | 2/418 |
| 4,630,317 | 12/1986 | Brown | 2/DIG. 11 |
| 4,856,116 | 8/1989 | Sullivan | 2/DIG. 11 |
| 4,941,210 | 7/1990 | Konucik | 2/181.4 |

FOREIGN PATENT DOCUMENTS

| | | | |
|---|---|---|---|
| 569860 | 2/1959 | Canada | 2/181 |

*Primary Examiner*—Werner H. Schroeder
*Assistant Examiner*—Diana L. Biefeld
*Attorney, Agent, or Firm*—George E. Kersey

[57] ABSTRACT

A method of adapting headgear by installing removable segment members which can be thereafter removed to achieve an alternate adaptation of the headgear or by inserting a removable liner which can be enlarged or reduced in thickness in order to precisely to accommodate the head size of a user.

9 Claims, 2 Drawing Sheets

SANITIZATION AND ADAPTATION OF HEADGEAR

BACKGROUND OF THE INVENTION

This invention relates to headgear and, more particularly, to the sanitization of headgear and its adaptation to a wide variety of uses.

Headgear for covering and protecting selected portions of the head typically is formed by a shell that often includes an outer brim that forms a sun and rain shield. The interior of the shell generally includes a band that encircles either a portion or the entire interior of the shell. The typical interior band is fabricated of leather or some other flexible material and absorbs head perspiration of the user, particularly in the case of headgear worn when it is hot and in tropical climates.

Unfortunately, the amount of perspiration that penetrates into the interior band, also known as a sweat band, can become appreciable. In addition, dust in the air combines with the perspiration to produce a stain on the band and create an unsanitary condition.

In addition the absorption of moisture by the interior band of headgear can embrittle the band and otherwise cause it to lose its effectiveness, e.g. by making it less comfortable on the head of the user.

Accordingly, it is an object of the invention to promote the sanitary use of headgear. A related object is to remedy the stains produced in the interior bands of headgear. Another related object is to enhance the aesthetic appearance of headgear, particularly that associated with the interior bands of headgear.

A further object of the inventiuon is to promote the comfortable fit of headgear to the head of a user, particularly over relatively long periods.

Another problem confronted in the use of head gear is that the shell does not always conform to the head of the user. In some cases the headgear is oversized; in other cases it is too small.

Accordingly, it is another object of the invention to provide for the modification of head gear and adapt it to the particular head of the user, regardless of whether the item is initially oversized or undersized.

SUMMARY OF THE INVENTION

In accomplishing the foregoing and related objects, the invention provides a method of adapting headgear formed by a cover having a interior for shielding selected portions of the head, by installing a removable member into the interior of the headgear and removing the member to achieve an alternate adaptation of the headgear.

In accordance with one aspect of the invention the member is removed to sanitize the headgear. Alternatively, the member is removed to change the fit of the headgear to the head of a user.

This can further include the step of replacing the removable member when it becomes soiled, or when it becomes undesirably affected by perspiration from the head of the user.

The removable member can be a sweat band formed by an outer layer and an inner compliant layer. The removable member can occupy a portion of the interior circumference of the shell, or it can occupy the entire interior circumference of the shell.

In accordance with a method of adapting an item of headgear to the head of a user, when the head gear is initially of improper head size, an item of headgear is selected which is nominally larger than the head size of the user and a removable liner is inserted into the headgear. The liner can be enlarged or reduced in extent in order to precisely accommodate the head size of the user.

An item of headgear in accordance with the invention is formed by a shell having an interior proportioned to envelope selected portions of the head of a user and a removable liner for the interior which can be adjusted in accordance with the intended usage of the headgear.

In accordance with one aspect of the invention the removable liner can be a sweat band. Alternatively the removable liner is a pad for adjusting the fit of the headgear to the head of a user. The removable liner can be a band that partially encircles the interior of the headgear, or it can completely encircles the interior. The removable liner can include a connecting material that joins the liner to the interior of the headgear, and the removable liner can be joined to the interior of the headgear by a complementary connecting material. The removable line can be connected to the headgear at a plurality of discrete positions, and can have a multiply construction.

One of the plies of the liner is intermediately positioned between the outer ply of the liner and the interior of the headgear, and the intermediate ply is of foam plastic material. This promotes the comfort adaptation of the headgear to the head of a user.

DESCRIPTION OF THE DRAWINGS

Other aspects of the invention will become apparent after considering several illustrative embodiments, taken in conjunction with the drawings, in which.

DETAILED DESCRIPTION

Figure 1:
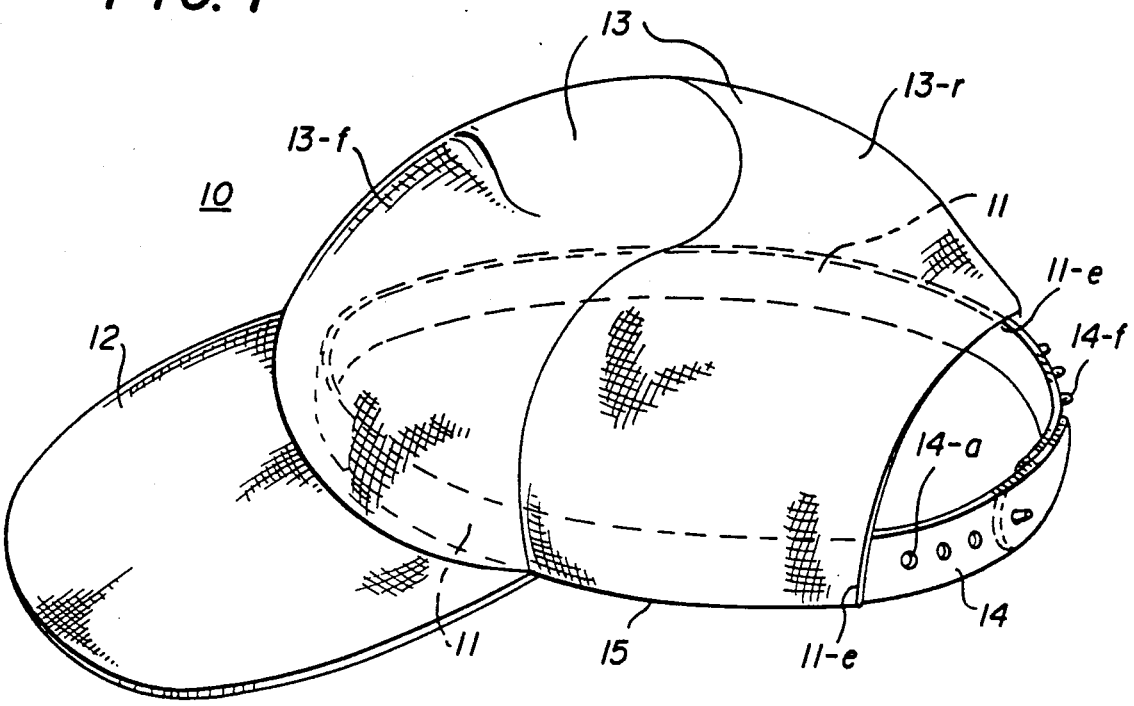
FIG. 1 is a perspective view of a cap which has been adapted in accordance with the invention.

With reference to the drawings, FIG. 1 shows a cap 10 which has been adapted in accordance with the invention by having a modified liner 11, described in detail below. In addition to the liner 11, the cap 10 has a bill 12 and a cover 13. The latter illustratively has a two-part construction so that the rear portion 13-R is of mesh for ventilation, and the frontal portion 13-F is of standard cloth construction. In addition, the liner 11 only partially encircles the base of the cover 13. The ends 11-E are attached to an adjustable two-part band 14 with standard adjustment apertures 14-a and fittings 14-F.

Figure 2A:
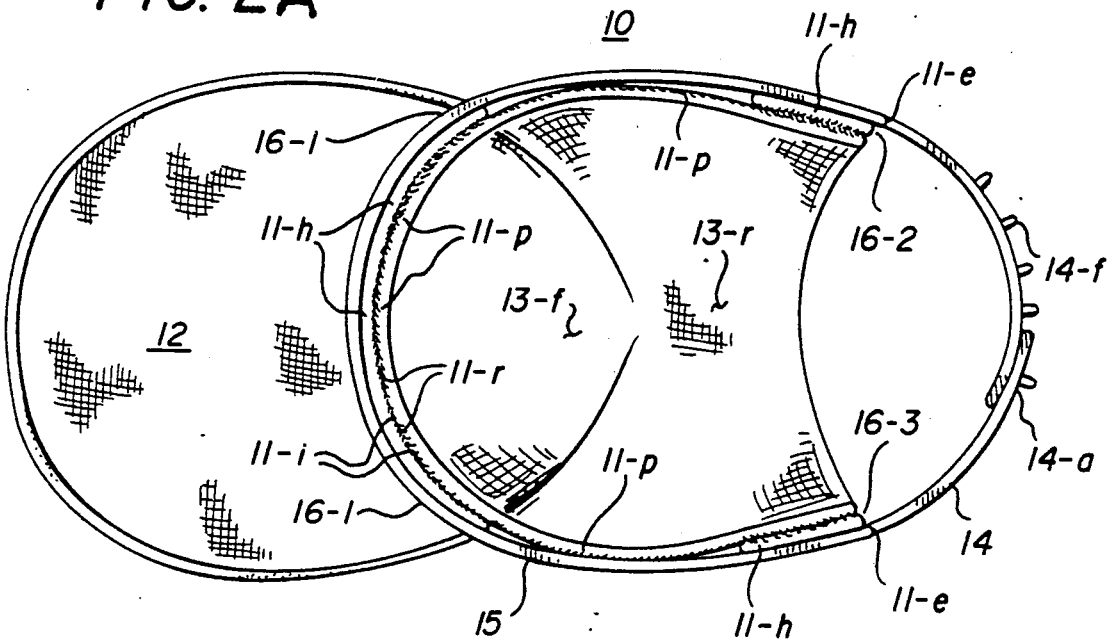
FIG. 2A is a bottom view of the cap of FIG. 1 illustrating the adaptation of the cap in accordance with the invention.
Figure 2B:
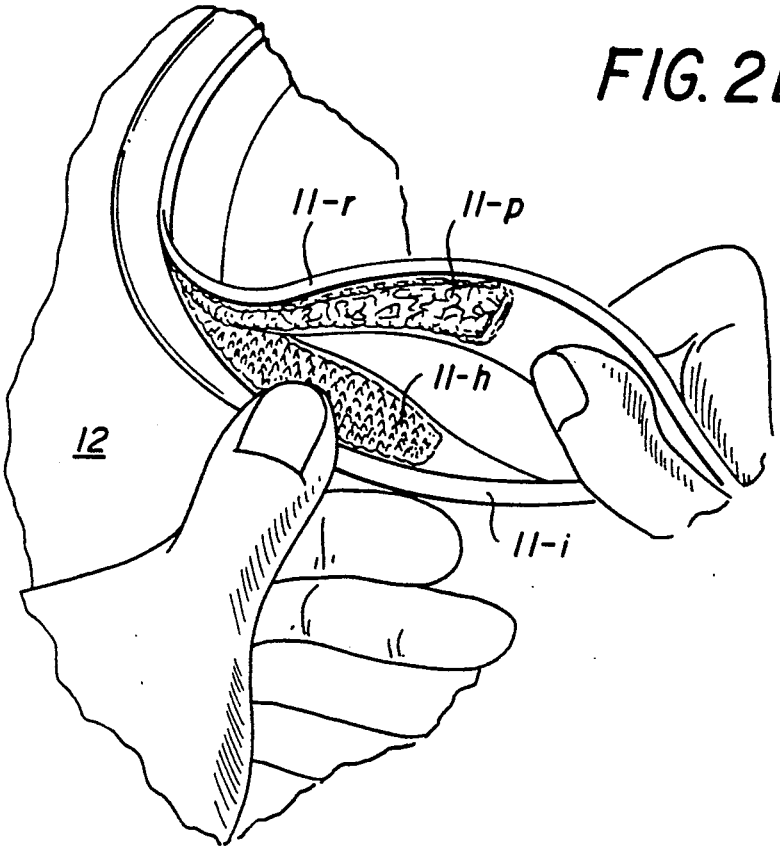
FIG. 2B is a partial view of FIG. 2A illustrating removal of a cap liner in accordance with the invention.

The modified liner 11, as shown in FIGS. 2A & 2B includes a conventional interior band 11-I that is attached to the base 15 of the cover 13 and a removable band 11-R that is adhered to the interior band 11-I at selective positions. For the particular band 11, there are three attachment positions 16-1, 16-2 and 16-3. The attachment position 16-1 extends along the front portion of the cap 10 behind the bill 12. The remaining attachment positions 16-2 and 16-3 are near the ends 11-E. It will be appreciated the attachment positions are for illustration only and that the attachment may be made continuously or more discretely as desired.

Suitable attachment is made using complementary fastening materials. A particularly suitable material is provided by the complemenmtary fasteners sold and marketed under the name "Velcro". This kind of material includes a layer with hook-like projections that engage a complemenmtary layer with loops or nap.

For the particular embodiment of FIGS. 1 & 2, the hook layer 11-H is attached at the positions 16-1 through 16-3 to the interior band 11-I, and the loop layer 11-P is attached opposite the hook layer 11-H to the removable band 11-R. The latter includes a layer of plastic foam 11-F surrounded by a cloth cover 11-c to provide comfort, as well as an escape conduit for sweat.

Figure 3A:
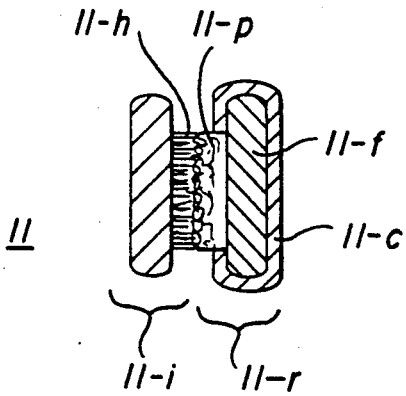
FIG. 3A is a cross-sectional view taken along the line 3A—3A of FIG. 2A.
Figure 3B:
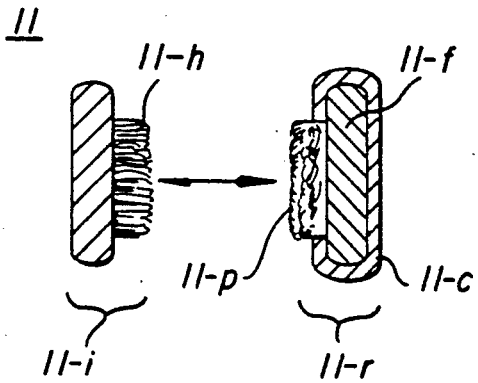
FIG. 3B is a cross-sectional view taken along the line 3B—3B of FIG. 2B.

Details of the liner 11 are shown in FIG. 3A where the inner and outer bands 11-I and 11-R are joined, and FIG. 3B where they are separated.

It will be appreciated that the invention may be used with ordinary headwear, such as standard, non-adjustable caps and hats to permit the headwear to sized to the head of the wearer. In that case the selected headwear is initially oversized and liners of various thickness are inserted until an appropriate fit is realized. In addition, although the hook layer 11-H is on the interior band 11-I, it may instead be located on the removable band 11-R, and the removable band may extend over the entire interior of the headwear.

Other aspects of the invention will be readily apparent to those of ordinary skill in the art.

What is claimed is:

1. The method of adapting headgear formed by a cover having a interior for shielding selected portions of the head, which comprises the steps of (a) installing into the interior of the headgear, against a complementary fastening material, a removable segment which is shaped to fit around only a portion of said interior; and (b) removing said segment to permit the replacement thereof by a different segment to achieve an alternate adaptation of said headgear with the replaced segment;

wherein the complementary fastening material has an unequal length in comparison with the removable segment.

2. The method of claim 1 wherein said segment is attached to said interior only at a plurality of distinctive and selective positions, separated from one another, and said segment is removed to sanitize said headgear.

3. The method of claim 1 wherein said segment is removed and replaced by a thicker segment to change the fit of said headgear to the head of a user.

4. The method of claim 1 further including the step of replacing said removable segment each time it becomes soiled.

5. The method of claim 2 wherein said distinctive and selective positions include complementary fastening materials, further including the step of replacing said removable segment when it becomes undesirably affected by perspiration from the head of the user.

6. The method of claim 1 wherein the removable segment is formed by an outer attachment layer, an inner compliant layer and a cover layer that surrounds said inner layer and joins the ends of said attachment layer.

7. The method of claim 1 wherein the interior of the headgear forms a cover shell and the removable segment occupies and is restricted to a portion of the interior circumference of the shell.

8. The method of claim 1 wherein the interior of the headgear forms a shell having a base circumference and said removable segment occupies the entire interior base circumference of the shell.

9. The method of adapting an item of headgear to the head of a user when the headgear is initially of improper head size which comprises the steps of (a) selecting an item of headgear which is nominally larger than the head size of the user; and (b) inserting into the headgear a removable liner which can be replaced by a substitute liner which is enlarged or reduced in thickness in order to precisely accommodate the head size of the user.

* * * * *